US011850706B2

(12) United States Patent
Fischer et al.

(10) Patent No.: US 11,850,706 B2
(45) Date of Patent: Dec. 26, 2023

(54) ABRASIVE TOOL AND USE OF SUCH AN ABRASIVE TOOL

(71) Applicant: LUKAS-ERZETT VEREINIGTE SCHLEIF- UND FRASWERKZEUGFABRIKEN GmbH & CO. KG, Engelskirchen (DE)

(72) Inventors: Gerd Fischer, Gummersbach (DE); Bernhard Runden, Bornheim (DE); Sebastian Schwark, Engelskirchen (DE)

(73) Assignee: LUKAS-ERZETT VEREINIGTE SCHLEIF- UND FRASWERKZEUGFABRIKEN GmbH & CO. KG, Engelskirchen (DE)

( * ) Notice: Subject to any disclaimer, the term of this patent is extended or adjusted under 35 U.S.C. 154(b) by 1005 days.

(21) Appl. No.: 16/633,829

(22) PCT Filed: Jul. 17, 2018

(86) PCT No.: PCT/EP2018/069406
§ 371 (c)(1),
(2) Date: Jan. 24, 2020

(87) PCT Pub. No.: WO2019/020438
PCT Pub. Date: Jan. 31, 2019

(65) Prior Publication Data

US 2020/0238476 A1 Jul. 30, 2020

(30) Foreign Application Priority Data

Jul. 25, 2017 (DE) ..... 102017116851.6

(51) Int. Cl.
*B24D 3/00* (2006.01)
*B24D 3/34* (2006.01)
(Continued)

(52) U.S. Cl.
CPC ..... *B24D 3/002* (2013.01); *A45D 29/05* (2013.01); *A45D 29/14* (2013.01); *B24D 3/346* (2013.01); *B24D 9/00* (2013.01); *B24D 2205/00* (2013.01)

(58) Field of Classification Search
CPC ..... B24D 3/002; B24D 3/346; B24D 9/00; A61C 3/00; A61C 3/02; A61C 3/06; A61C 3/025; A61C 3/04
See application file for complete search history.

(56) References Cited

U.S. PATENT DOCUMENTS 3,868,233 A 2/1975 Carver et al.
4,389,192 A * 6/1983 Neuwirth ..... A61C 3/06 433/166
(Continued)

FOREIGN PATENT DOCUMENTS

CN 103341829 A 10/2013
CN 104665209 A 6/2015
(Continued)

OTHER PUBLICATIONS

International Search Report for PCT/EP2018/069406 dated Aug. 16, 2018 [PCT/ISA/210].

*Primary Examiner* — Pegah Parvini
(74) *Attorney, Agent, or Firm* — Sughrue Mion, PLLC

(57) ABSTRACT

An abrasive tool, including an abrasive carrier (1) having a shaft (2) for connecting the abrasive carrier (1) to a driving device for rotatably driving the abrasive carrier (1) about a longitudinal axis (X) and having a core (3) connected to an axial end (4) of the shaft (2), and an abrasive article (15)
(Continued)

having a surface (16) being circumferentially closed about the longitudinal axis (X) and enclosing a cavity (17) extending along the longitudinal axis (X), wherein the core (3) is accommodated at least partially in the cavity (17), and wherein the core (3) includes a material mixture which includes a plastic with a heat-conductive filler, wherein the plastic is foamed, and wherein the filler has a thermal conductivity greater than 35 watts per meter and per Kelvin.

21 Claims, 1 Drawing Sheet

(51) Int. Cl.

| | |
|---|---|
| ***B24D 9/00*** | (2006.01) |
| ***A45D 29/05*** | (2006.01) |
| ***A45D 29/14*** | (2006.01) |

(56) References Cited

U.S. PATENT DOCUMENTS

| | | | | |
|---|---|---|---|---|
| 4,446,657 | A | 5/1984 | Asaeda et al. | |
| 5,645,476 | A | 7/1997 | Meyer | |
| 7,493,670 | B1 | 2/2009 | Brogan | |
| 2007/0221238 | A1 | 9/2007 | Tran | |
| 2009/0068614 | A1* | 3/2009 | Sonoi | B24D 3/32 433/166 |
| 2015/0150353 | A1 | 6/2015 | Yiu | |
| 2016/0051283 | A1* | 2/2016 | Runden | A61C 3/06 451/533 |
| 2017/0028528 | A1 | 2/2017 | Gollapudi et al. | |

FOREIGN PATENT DOCUMENTS

| | | | |
|---|---|---|---|
| DE | 2 411 859 | A | 9/1974 |
| DE | 40 06 660 | A1 | 9/1991 |
| DE | 20 2014 007 228 | U1 | 5/2015 |
| FR | 2 020 424 | A1 | 7/1970 |
| FR | 2 484 313 | A | 12/1981 |
| GB | 1 099 703 | A | 1/1968 |
| GB | 1 279 413 | A | 6/1972 |
| JP | 2001-54870 | A | 2/2001 |
| WO | 03/099496 | A2 | 12/2003 |

* cited by examiner

ABRASIVE TOOL AND USE OF SUCH AN ABRASIVE TOOL

CROSS REFERENCE TO RELATED APPLICATIONS

This application is a National Stage of International Application No. PCT/EP2018/069406 filed Jul. 17, 2018, claiming priority based on German Patent Application No. 102017116851.6 filed Jul. 25, 2017.

BACKGROUND OF THE INVENTION

Field of the Invention

The invention relates to an abrasive carrier having a shaft for connecting the abrasive carrier to a driving device for rotatably driving the abrasive carrier about a longitudinal axis and having a core connected to an axial end of the shaft. The invention also relates to an abrasive tool comprising such an abrasive carrier and an abrasive article having a surface being circumferentially closed about the longitudinal axis and enclosing a cavity extending along the longitudinal axis. The core of the abrasive carrier is at least partially arranged in the cavity. Furthermore, this invention relates to the use of such an abrasive tool.

Background

Abrasive tools of this type are well known and are used, for example, for metalworking, foot care, manicure or the dental sector. The abrasive carriers used in the state of the art, which are also called mandrels, are usually expanding bodies made of slotted rubber with a metal shaft embedded therein to connect the abrasive carrier to a driving device. The slots running in the longitudinal direction shall ease the pull on and/or removal of the circumferentially closed abrasive articles, for example a seamless abrasive cap or an abrasive sleeve, onto or from the abrasive carrier. During operation, the abrasive carrier clamped in the driving device is rotated about the longitudinal axis. At a sufficiently high rotation speed, the slotted abrasive carrier fans out, i.e. increases its outer diameter, and due to the centrifugal forces presses against the circumferentially closed surface of the abrasive article.

It is considered to be disadvantageously that the rubber as a material has a low temperature stability and a low shape stability, so that the abrasive carrier made of rubber may contract due to the frictional heat generated during grinding process. Thus, the desired expansion effect caused by the fanning out of the slotted abrasive carrier is partially compensated by the contraction of the rubber under heat impact. Especially when the abrasive tool is pressed against the object to be treated with a high contact pressure, on the one hand, a high heat development occurs, which causes the abrasive carrier made of rubber to shrink. On the other hand, regularly the rotation speed of the driving device decreases, so that the centrifugal forces acting on the abrasive carrier decrease. This results in a reduced static friction between the abrasive carrier and the mounted abrasive article, giving rise to the danger that the abrasive article slips off the abrasive carrier during operation of the abrasive tool. In order to prevent this, some propose to further increase the outer diameter of the abrasive carrier. The downside of this proposal is that, when the abrasive carrier is in its cold condition, the abrasive article can only be pulled on or removed from it with increased force, so that the advantage promised by the slots in the abrasive carrier is put into perspective again.

Furthermore, abrasive carriers made of metal materials are known in the state of the art. These offer the advantage of highest temperature stability. However, these have a higher dead weight and a hard and inflexible surface. In addition, the static friction between the abrasive carrier and the abrasive article is significantly lower with metal abrasive carriers compared to those made of rubber, so that clamping devices are needed to hold the abrasive article securely at the abrasive carrier during rotation. However, those clamping devices are costly and time-consuming to handle.

From DE 20 2014 007 228 U1 an abrasive tool with exchangeable sanding rollers is known. The sanding rollers have a multi-part core with two core sections and an abrasive article held between the core sections. The hollow cylindrical abrasive article is made of a solid foam material and has abrasive material on its outer side. Due to the foam-lined abrasive material the abrasive article may adapt to the contour of the body part to be treated, e.g. a fingernail.

U.S. Pat. No. 7,493,670 B1 discloses a polishing tool with an abrasive carrier made from an elastic core which can be connected to a driving device via a shaft. The elastic core can consist of closed cell polyurethane, wherein the core is molded on the shaft. A soft cotton cloth bag may be placed over the core and may be fitted with a drawstring to secure the cloth bag on the core. The cloth bag may be filled with an abrasive or polish material.

From DE 2 411 859 A1 a cup type grinding wheel with a hardened resin-based core is known. In order to increase the thermal conductivity, the core contains large amounts of metal particles, namely 40 to 90 volume percent of aluminum and/or copper powder and 35 to 2 volume percent of tin and/or tin alloy.

The object of the present invention is to provide an improved abrasive carrier which is easier to handle and reliably prevents heat-related damage to the abrasive carrier or the object to be treated even during longer grinding cycles. Furthermore, the object of the present invention is to provide an improved abrasive tool with such an abrasive carrier.

SUMMARY OF THE INVENTION

The invention is based on the observation that plastic is heat-insulating and therefore only allows short abrasive cycles in order to prevent heat-related damage to the abrasive carrier or to the object to be treated, in particular to a workpiece or a to be treated part of a patient's body.

The object is solved by an abrasive carrier of the type mentioned above in that the core consists of a material mixture comprising a plastic with a heat-conductive filler, wherein the plastic is foamed, and wherein the filler has a thermal conductivity greater than 35 watts per meter and per Kelvin. The plastic is foamed. In other words, the material mixture of the core has a plastic-based foam material. Furthermore, the object is solved by an abrasive tool of the type mentioned above in that the core of the abrasive carrier consists of a material mixture comprising a foamed plastic with a heat-conductive filler, the filler having a thermal conductivity greater than 35 watts per meter and per Kelvin.

According to the invention, the whole core is based on preferably elastic plastic, to which the heat-conductive filler is added in order to increase thermal conductivity of the core. Thus, the filler can distribute the thermal energy absorbed on the outer surface of the abrasive carrier throughout the core. As a result, the outer surface of the abrasive carrier cools down faster so that the frictional heat generated on the abrasive article during operation of the abrasive tool is transported away from the abrasive article into the core. By this, longer grinding cycles are possible without the fear of heat-related damages to the object to be machined or to be treated, to the abrasive carrier itself, or to the abrasive article. In addition, due to said faster cooling the pauses between each of the grinding cycles can be shortened. Furthermore, with the heat-conductive filler the stock removal rate of the abrasive tool and the average service life of the abrasive carrier could be significantly increased compared to known rubber abrasive carriers without heat-conductive filler. This results in safer and more efficient grinding.

Thermal conductivity describes the ability of a material to transport thermal energy by means of heat conduction. This is expressed by the coefficient of thermal conductivity $\lambda$ in watts per meter and per Kelvin (W/mK). It has been shown that a core made of, for instance, flexible PUR (polyurethane), in particular of soft PUR foam, can be used to provide an abrasive carrier that patients find comfortable. In principle, however, the core can also be made of elastic PUR rigid foam or another plastic that is elastic in its foamed or non-foamed condition. However, the polyurethane foam, mentioned here by way of an example, has a low coefficient of thermal conductivity of about 0.04 W/mK, wherein the thermal conductivity only marginally depends on the foam density. To enable longer grinding cycles despite the heat-insulating effect of the plastic, it has been shown to be particularly advantageous that the filler has a thermal conductivity greater than 35 watts per meter and per Kelvin, in particular greater than 80 watts per meter and per Kelvin.

Since foam is generally formed from gaseous bubbles enclosed by solid or liquid walls, the foamed plastic has a low dead weight. This significantly reduces the weight of the core compared to a non-foamed plastic. This is advantageous because it allows the weight of the filler to be partially compensated, especially if it is a metal or mineral filler. The volume of the foamed plastic may be approximately 70% to 95% of the total volume of the core, wherein the volume of the filler and the volume of a potential added functional additive in sum is at most 30% of said total volume. Thus, the core remains elastic despite the addition of the inelastic filler. As a result, due to the production of the core from a plastic-based foam material with the fillers embedded therein, an abrasive carrier of significantly lighter total weight is provided.

Preferably, the filler is inorganic, in particular metal or mineral. The filler may be added in powder form or in liquid form to the plastic. For instance, the filler may be silver, copper or another highly heat-conductive metal. Particularly good results were also achieved with silicon carbide. In addition to or as an alternative to metal or mineral fillers carbon nanotubes can also be used, which have a particularly light weight and high heat-conductive properties. The filler can also be a mixture of different heat conducting materials. Depending on the requirements placed on the abrasive carrier, the filler can provide the core with further advantageous properties in addition to the preferred heat conduction. For example, silver, especially colloidal silver, has an additional anti-bacterial and/or anti-fungal effect. These properties are particularly relevant when the abrasive carrier is used on patients. Particularly good results were achieved when the filler is homogeneously distributed in the core. In principle, however, an in particular radially outer section of the core may have a higher filler concentration than the rest of the core.

The plastic or synthetic resin may be flexible. The plastic or synthetic resin can be polyurethane, for example. Basically, however, elastic polymers, silicones, synthetically produced rubber or natural rubber are also suitable. With regard to foamed plastics, this can preferably be a one- or two-component plastic. Particularly good results were achieved with two-component plastics which cure more uniformly and foam more strongly due to chemical reaction between the two components. Alternatively, the plastic can also be foamed with propellant. It is advantageous when the filler can be added to at least one component of the plastic before foaming, so that the filler is distributed as homogeneously as possible in the core. It has also been shown that the core having foamed plastic is particularly temperature-stable.

To connect the shaft, which can be elongated and cylindrical, with the core, the core is molded or sprayed on the shaft. For this purpose, the shaft can be held into the material mixture already during production of the core. To improve the adhesion between the core and the shaft, a bonding agent can first be applied onto the axial end of the shaft. Preferably, the axial end of the shaft may comprise embossments which serve to anchor the core to the shaft. As a result, an abrasive carrier is provided with the shaft being permanently bonded to the core, wherein the shaft can only be separated by destroying the core.

Furthermore, the shaft may be made of a material, in particular metal, which has a higher thermal conductivity than the plastic, in particular a thermal conductivity greater than 35 watts per meter and per Kelvin. This allows the core to cool down faster. Especially in a core-less area, i.e. in an area of the shaft not covered by the core, the shaft usually has an even surface in order to easily connect and/or clamp the shaft to the driving device. In order to better dissipate the thermal energy absorbed by the core, the shaft may have heat transfer means formed on the shaft in a shaft area being outside the core. Preferably, the heat transfer means are arranged between a clamping area of the shaft, which is formed at an axial end of the shaft remote from the core and in particular has an even surface for connection to the driving device, and the opposite axial end of the shaft overlapped by the core. The heat transfer means may be, in particular, embossments, corrugations, grooves, elevations, wings or the like which increase the surface area of the shaft compared to an even or smooth surface in order to dissipate thermal energy into the environment. Preferably, the heat transfer means with wing-like or turbine-like geometries can be aligned on the shaft such that surrounding air is sucked in and the abraded particles during the grinding process are blown away. Preferably, the abrasive article does not overlap the heat transfer means. Another advantage is that the heat transfer means can also serve as a clamping aid when connecting the abrasive carrier to the driving device. For this purpose, the clamping area can have an even surface in the known manner, whereby an optimum clamping depth of the shaft in the driving device is indicated to the user of the abrasive carrier by the beginning of the heat transfer means, which can be for example the corrugation.

Furthermore, at least one radially projecting flange may be arranged at the shaft, wherein the flange is made of a material which has a higher thermal conductivity than the plastic, in particular has a thermal conductivity greater than 35 watts per meter and per Kelvin. By this, the flange can absorb thermal energy and release it into the environment.

The flange may be made of the same material as the shaft or of a material having a higher thermal conductivity than the shaft. The flange can be ring-shaped or interrupted in circumferential direction around the longitudinal axis. Furthermore, an outer side of the flange can be arranged in a plane together with an end face of the core facing the shaft. The flange can rest on the end face of the core or be flush with the end face of the core. Due to this arrangement of the flange the production of the abrasive carrier is simplified. Thereby, the flange prevents the bonding agent, which may be liquid and can be applied to the axial end of the shaft before joining the shaft with the core, from running into the remaining core-less part of the shaft.

Preferably, the core consists of 25 to 75 weight percent, in particular of 50 to 55 weight percent, of the filler and 0 to 10 weight percent of at least one functional additive, wherein the remainder of the core consisting of the plastic and unavoidable impurities. Polyurethane is particularly suitable as a plastic. The foamed plastic can be closed porous. The plastic can have a volume weight or density of 700 to 1250 kilograms per cubic meter. Furthermore, the plastic can have a Shore hardness A of 30 to 90. Shore hardness A is standardized according to DIN ISO 7619-1 and measures the indentation/penetration depth of a frusto-conical steel pin in a test specimen on a scale of 0-100. For metalworking, the core is best made of a plastic with a Shore hardness A of 30 to 90, preferably up to 80, more preferably up to 70. Thus, the core is more flexible, so that when the abrasive tool is positioned on in particular hard edges of a metal workpiece, the risk of grit eruption from the abrasive layer is reduced. By suitable selection of the hardness of the particularly foamed plastic an abrasive carrier with a flexible and/or elastic core, which can adjusts itself to the contour of the object to be worked on and/or the body part to be treated, or with a more rigid core, which is well applicable among other things in the podology, is provided.

According to an aspect of the present invention, it may be provided that the material mixture of the core contains at least one functional additive. The at least one functional additive may be added as a powder or liquid to the plastic. The at least one functional additive may contain thermochromic color pigments and/or anti-bacterial agents and/or anti-fungal agents and/or friction modifying agents. Anti-bacterial and/or anti-fungal agents can be added in particular to those abrasive carriers which are intended for use on patients to provide an abrasive carrier which is as hygienic as possible. The at least one functional additive can be silver, in particular colloidal silver, or copper, for instance. By suitable selection of the additive, also the coefficient of static friction of the outer surface of the core can also be modified, especially be increased, to ensure secure hold of the abrasive article.

In particular during metal-, wood-, and plastic-processing the abrasive carrier can often become very hot, so that the object to be treated, or the abrasive carrier, or the abrasive article, or even the fingers of the user could suffer harm. To reliably prevent this, reversible and/or irreversible thermochromic color pigments can be added to the abrasive carrier, which visually indicate with at least one color change that at least a defined temperature or a critical temperature range has been reached. This allows the user of the abrasive carrier to be visually informed that the abrasive article and/or the abrasive carrier has become, for instance, too warm. At this, it is made use of the effect of thermochromism, i.e. certain substances change their color when warmed up. Coming from the color of the thermochromic colorants, for instance color pigments, in cool condition, for example by room temperature, a rise in temperature is indicated to the user by changing the color of the color pigments. For example, initially dark color pigments could indicate the rise in temperature by changing color to red. The thermochromic color pigments enable the user to react to overheating, for example by reducing the contact pressure, by regulating the rotation speed of the driving device, or by interrupting the grinding process. Due to the use of the heat-conductive filler the outer surface of the core cools down fast again, so that reversible color pigments can also be used to indicate the cooling of the abrasive carrier. When additionally or alternatively irreversible color pigments are used, it can be permanently indicated to the user that the abrasive carrier has been operated above a maximum permissible external surface temperature, for instance, by providing for an irreversible color change once the maximum permissible external surface temperature has been reached. By this, already the first-time overheating of the abrasive carrier is permanently indicated. Irreversible color pigments may change color when an external surface temperature just above room temperature is reached, so that after a short grinding process it is permanently indicated that the abrasive carrier has already been used once. The at least one color change is indicated clearly enough to the user when the amount of the thermochromic color pigments is up to 10 weight percent of the material mixture.

The abrasive carrier may also have a coating applied to the surface of the core, wherein the coating comprising the thermochromic color pigments and/or anti-bacterial agents and/or anti-fungicidal agents.

The inventive abrasive tool invention comprises besides the inventive abrasive carrier the abrasive article. The abrasive article is interchangeably arranged on the core. Preferably, the abrasive carrier can be used for more than one grinding operation, whereas the abrasive article can be a wear product.

The surface of the abrasive article is circumferentially closed around the longitudinal axis of the abrasive carrier and encloses a cavity extending along the longitudinal axis of the abrasive carrier. Thus, the abrasive article can have a cylindrical, or tapered, or conical, or spherical, or in parts cylindrical and hemispherical, or cap-shaped surface, wherein other geometric shapes are also possible. The abrasive article can be an in particular seamless abrasive cap which can be pulled on the core of the abrasive carrier. The abrasive article can also be an abrasive sleeve which only partially encloses the core. Preferably, the shape of an outer surface of the core is at least partially complementary to the surface of the abrasive article surrounding the cavity. Accordingly, the core may have a cylindrical, or tapered, or conical, or spherical, or partially cylindrical and hemispherical, or cylindrical outer surface, wherein other geometric shapes are also possible. This allows the abrasive article with its surface facing the core to lie flat against the core so that the core connects the abrasive article with the shaft. Friction between the outer surface of the core and the surface of the abrasive article causes the abrasive article to hold on the abrasive carrier. This allows the exchangeable abrasive article held on the core to be changed simply by pulling it over the core or pulling it off the core. The abrasive article is, thus, a component separate from the abrasive carrier, which is held on the core only by static friction. By this, the abrasive tool can in principle be used with abrasive articles that are adapted to the respective application, so that abrasive articles with different grinding properties or strengths can be used, for example. The abrasive article is made of a preferably flexible material such as abrasive cloth. The abrasive cloth may have a preferably flexible backing material which is coated with an abrasive material on an abrasive side facing away from the core.

To further increase the static friction between the outer surface of the core and the surface of the abrasive article, the outer surface of the core can be a lateral surface that is circumferentially closed around the longitudinal axis. This means, that the outer surface has a continuous surface without slots or the like. This also makes the core easier to be cleaned. The closed surface can be smooth and nonporous, respectively, or porous. In particular, the core can consist of a closed-pore foam material, whereby good static friction values can also be achieved with an open-pore foam material. Preferably, the maximum outside diameter of the core is equal to or slightly smaller than the maximum inside diameter of the abrasive article. This allows the abrasive article to be easily attached to and removed from and also to be securely hold during rotation on the core. Particularly good results were achieved with the core, whose material mixture contains the foamed plastic, since the core with its light foam material and the heavy filler embedded in the foamed plastic presses from the inside against the surface of the abrasive article during rotation about the longitudinal axis.

As an alternative to the closed lateral surface, the outer surface of the core can be a lateral surface that is interrupted circumferentially around the longitudinal axis. The interruptions may be slotted and may extend in a longitudinal direction defined by the shaft. If required, the interruptions can be cut into the core after manufacture or directly during manufacture, for example by casting or spraying of an in particular lamellar surface. Due to the centrifugal forces acting on the core during the rotation of the abrasive carrier, the core can thus fan out, i.e. increase its outer diameter, and press from the inside against the surface of the abrasive. Furthermore, a maximum outside diameter of the core may be larger than a maximum inside diameter of the abrasive article to further increase the static friction between the outer surface of the core and the surface of the abrasive article. This provides a press fit between the core and the abrasive article, which holds the abrasive article securely on the abrasive carrier during operation of the abrasive tool. Due to the interrupted lateral surface of the core, the core can also be easily compressed by hand in order to reduce the static friction in relation to the abrasive carrier for a short time for the attachment or removal of the abrasive article.

According to another aspect, the abrasive article may have reversible and/or irreversible thermochromic colorants to determine an external surface temperature of the abrasive article. Analogous to the thermochromic color pigments that can be mixed as additives to the core, the user can be informed by color change that a defined temperature or a critical temperature range has been reached. Especially for that case, when the abrasive articles are designed as abrasive caps that completely cover the core, it can be useful to arrange the thermochromic color pigments in the abrasive article. By using the heat-conductive filler, the outer surface of the abrasive carrier is cooled down fast even after a short interruption, because the frictional heat is transported away into the core. This prevents heat build-up on the outer surface of the core, so that the external surface temperature of the abrasive article is indicated more precisely by the thermochromic color pigments, especially with a lower measuring error. This results in safer and more efficient grinding. In order to further accelerate the cooling of the outer surface of the abrasive carrier, the abrasive article can be open on at least one side facing the shaft, when the abrasive article is an abrasive cap, for instance, or the abrasive article can be open on both axial sides, when the abrasive article is an abrasive sleeve, for instance. By this, the thermal energy absorbed by the core can dissipate sideways into the environment.

Both the abrasive tool according to the invention and the abrasive carrier according to the invention can be used, for example, for metalworking and/or the treatment of human body parts, in particular in connection with a non-therapeutic or cosmetic treatment of a patient, for example for foot care, manicure or dental care.

BRIEF DESCRIPTION OF THE DRAWINGS

Preferred embodiments are described in the following using the figures.

DETAILED DESCRIPTION OF THE INVENTION

Figure 1:
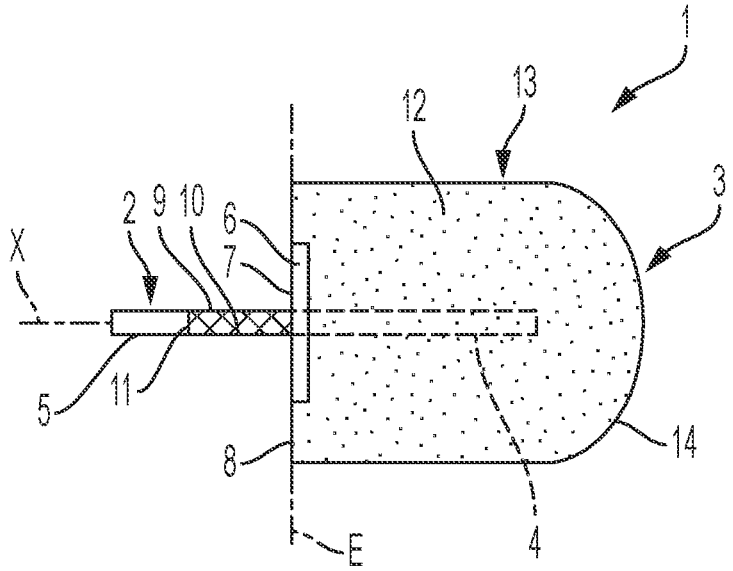
FIG. 1 shows a side view of an abrasive carrier according to the invention.

FIG. 1 shows an abrasive carrier 1 according to an embodiment of the invention. The abrasive carrier 1 comprises a metal shaft 2 and a core 3 made of a material mixture comprising a plastic with a heat-conductive filler and, here, other functional additives.

The shaft 2 has an elongated, pin-like basic shape with a front axial end 4 and a rear axial end 5, and defines a longitudinal axis X. The rear axial end 5 of the shaft 2 serves to connect the abrasive carrier 1 to a driving device (not shown) to rotate the abrasive carrier 1 about the longitudinal axis X. For this, the shaft 2 can be clamped, for example, in a chuck of the driving device. To securely hold the core 3 on the metal shaft 2, the shaft 2 has a roughened, in particular ribbed surface along the front axial end 4 that is covered by the core 5. In addition, on the shaft 2 a radially projecting flange 6, which has here a ring-like closed shape, is arranged. The flange 6 is also made of metal, and is, by way of example, as well as the shaft 2, made of steel, for instance. An outer side 7 of the flange 6 facing the rear axial end 5 of the shaft 2 is arranged in a plane E together with an end face 8 of the core 3 facing the shaft 2, i.e. the flange 6 is flush with the core 3. Furthermore, the shaft 2 has heat transfer means 10 within a shaft area 9 of the shaft 2 that is arranged outside the core 3. The heat transfer means 10 are, here, embossings which increase the surface area and thus the emission surface area of the shaft 2 in the shaft area 9. The rear axial end 5 of the shaft 2 has an even surface. Starting at the rear axial end 5, the beginning of the embossings 10 defines a clamping mark 11 indicating to the user the optimum clamping depth in the driving device.

The core 3 is rotationally symmetrical to the longitudinal axis X and has a solid body which, by way of example, has a cylindrical section and a hemispherical section. Alternative geometries are also possible. The shaft 3 is accommodated in the cylindrical section of the core 3. The material mixture of the core 3 is, here, foamed polyurethane, which is cured closed-pore. The foam is formed by gaseous bubbles enclosed by solid walls. Depending on the application for which the abrasive carrier 1 is intended, e.g. for metal-, plastic- or wood-processing or for the treatment of patients, the plastic can be provided with different properties. For example, the plastic can have a density of 700 to 1250 kilograms per cubic meter. Furthermore, the plastic can have a Shore hardness A of 30 to 90.

In the material mixture of the core 3 also the heat-conducting filler is provided, mixed with the plastic and distributed as homogeneously as possible in the core 3. In FIG. 1, the filler is, together with the other functional additives, indicated by the dots shown within in the core 3, wherein the dots are for the sake of clarity marked only once with the reference sign 12. The filler may be inorganic, in particular metal or mineral. For example, the filler can be silver, copper or silicon carbide. The filler may also include carbon nanotubes. Such fillers have a coefficient of thermal conductivity A of more than 35 W/mK. The fillers thus have a significantly higher thermal conductivity than the plastic, which, using foamed polyurethane as an example, has a coefficient of thermal conductivity of about 0.04 W/mK. In addition, the shaft 2 and the flange 6 are also made of a material, here of steel, which has a thermal conductivity of more than 35 W/mK and that is significantly higher than the thermal conductivity of the plastic.

In addition, the material mixture of the core 3 contains the functional additives. For one thing, the additives used here include thermochromic color pigments, which indicate to the user by color change that a defined temperature or a critical temperature range has been reached. The use of thermochromic color pigments in the core 3 of the abrasive carrier 1 is in particular useful when abrasive articles are used which only partially cover the core 3. For example, this could be a cylindrical abrasive sleeve arranged on the cylindrical section of the core 3.

Furthermore, the functional additives can influence the friction behavior of an outer surface 13 of the core 3. By this, the coefficient of static friction can be increased. Furthermore, anti-bacterial and anti-fungal additives, for instance silver or colloidal silver, are provided.

Thus, the core consists of, by way of example, 25 to 75 weight percent of the filler and 0.5 to 10 weight percent of the functional additives, wherein the remainder of the core 3 consists of the plastic, whereby marginal impurities cannot be excluded.

A coating 14 has been applied to the outer surface 13 of the core 3 which, in this case, contains anti-bacterial and anti-fungicidal agents to provide a starting product for the treatment of patients that is as hygienic as possible. In principle, the coating 14 could also contain thermochromic color pigments.

Figure 2:
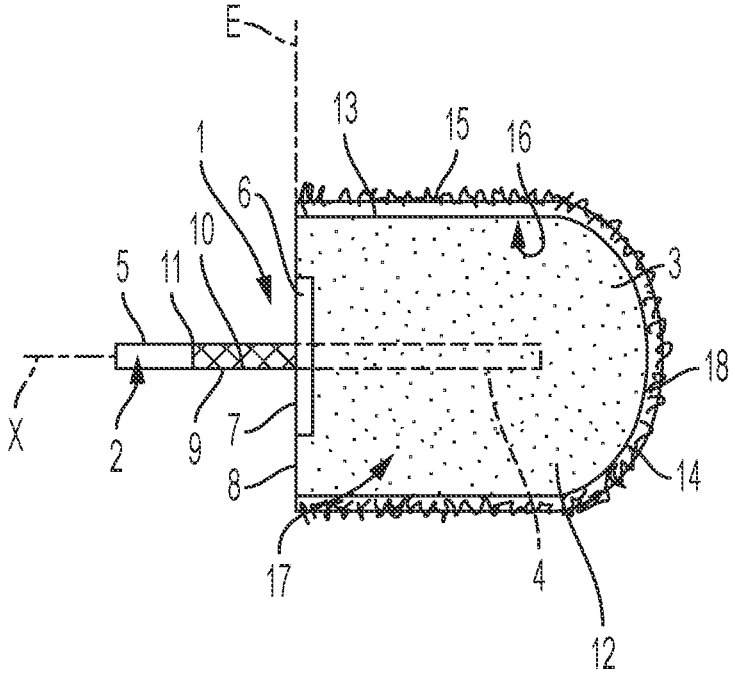
FIG. 2 shows a side view of an abrasive tool according to the invention with the abrasive carrier of FIG. 1.

FIG. 2 shows an abrasive tool according to the invention, which shows besides the abrasive carrier 1 of FIG. 1 an exchangeable abrasive article 15 that is pulled over the core 3.

The abrasive article 15 has a surface 16 that is circumferentially closed about the longitudinal axis X and encloses a cavity 17 extending along the longitudinal axis X. The abrasive article 15 is shown, by way of example, as a seamless abrasive cap. The core 3 of the abrasive carrier 1 already described in connection with FIG. 1 is accommodated in the cavity 17.

The outer surface 13 is complementary to the surface 16 and is designed as a lateral surface that is circumferentially closed around the longitudinal axis X. Thus, the surface 16 of the abrasive article 15 lies flat on the outer surface 13 of the core 3, so that the exchangeable abrasive article 15 is held only by the static friction force on the core 3.

On a side of the abrasive article 15 facing away from the core 3, an abrasive layer 18 is arranged which has abrasive grains bound in a binder, in particular resin. In the grinding layer 18, here, thermochromic color pigments are provided to determine an external surface temperature of the abrasive article 15, in particular of the abrasive layer 18.

When the abrasive tool is in operation, it is rotated about the longitudinal axis X by the driving device. During grinding operation, the friction between the abrasive article 15 and the object to be treated generates frictional heat, which is distributed into the core 3 by the heat-conducting fillers. The core 3 can dissipate the absorbed thermal energy via the end face 8 of the core 3 that is not covered by the abrasive article 15. The metal flange 6 as well as the metal shaft 2, especially due to the heat transfer means 10, support the dissipation of the thermal energy absorbed by the core 3 into the environment.

REFERENCE SIGNS LIST

1 abrasive carrier
2 shaft
3 core
4 axial end
5 axial end
6 flange
7 outer side
8 end face
9 shaft area
10 heat transfer means
11 clamping mark
12 fillers and functional additives
13 outer surface
14 coating
15 abrasive article
16 surface
17 cavity
18 abrasive layer
E plane
X longitudinal axis

The invention claimed is:

1. An abrasive tool comprising:

an abrasive carrier having a shaft for connecting the abrasive carrier to a driving device for rotatably driving the abrasive carrier about a longitudinal axis and having a core connected to an axial end of the shaft, and an abrasive article having a surface being circumferentially closed about the longitudinal axis and defining a cavity extending along the longitudinal axis, wherein the core is accommodated at least partially in the cavity, and wherein the core includes a material mixture comprising a plastic with a heat-conductive filler, wherein the plastic is foamed, and wherein the filler has a thermal conductivity greater than 35 watts per meter and per Kelvin.

2. Abrasive tool according to claim 1, wherein the volume of the foamed plastic is 70% to 95% of the total volume of the core, wherein the volume of the filler and the volume of at least one optional functional additive in sum is at most 30% of the total volume of the core.

3. Abrasive tool according to claim 1, wherein the core includes 25 to 75 weight percent of the filler and 0 to 10 weight percent of at least one functional additive, wherein the remainder of the core includes the plastic and unavoidable impurities.

4. Abrasive tool according to claim 3,
wherein the at least one functional additive is selected from the group comprising thermochromic color pigments, anti-bacterial agents, anti-fungicidal agents, friction modifying agents.

5. Abrasive tool according to claim 1,
wherein the plastic has a density of 700 to 1250 kilograms per cubic meter and/or a Shore hardness A of 30 to 90.

6. Abrasive tool according to claim 1,
wherein the plastic is a one-component plastic or a two-component plastic.

7. Abrasive tool according to claim 1,
wherein the plastic is selected from the group comprising polyurethane, elastic polymers, silicone, synthetically produced rubber and natural rubber.

8. Abrasive tool according to claim 1,
wherein the filler is inorganic.

9. Abrasive tool according to claim 1,
wherein the filler is selected from the group comprising silver, copper, silicon carbide and carbon nanotubes.

10. Abrasive tool according to claim 1,
wherein the filler is a mixture of different heat-conductive materials.

11. Abrasive tool according to claim 1,
wherein the filler is homogeneously distributed in the core.

12. Abrasive tool according to claim 1,
wherein a radially outer portion of the core comprises a higher concentration of the filler than the rest of the core.

13. Abrasive tool according to claim 1,
wherein the shaft is made of a material having a thermal conductivity greater than 35 watts per meter and per Kelvin.

14. Abrasive tool according to claim 1,
wherein the shaft comprises heat transfer means, which are formed on the shaft in a shaft area arranged outside the core.

15. Abrasive tool according to claim 1,
wherein at least one radially projecting flange is arranged at the shaft, wherein the flange is made of a material which has a thermal conductivity of greater than 35 watts per meter and per Kelvin.

16. Abrasive tool according to claim 15,
wherein an outer side of the flange is arranged in a plane together with an end face of the core facing the shaft.

17. Abrasive tool according to claim 1,
wherein the abrasive carrier comprises a coating which is applied onto the outer surface of the core, wherein the coating comprises thermochromic color pigments and/or anti-bacterial agents and/or an anti-fungal agents.

18. Abrasive tool according to claim 1,
wherein an outer surface of the core is shaped at least partially complementary to the surface of the abrasive article defining the cavity.

19. Abrasive tool according to claim 1,
wherein the outer surface of the core is a lateral surface being closed in the circumferential direction about the longitudinal axis.

20. Abrasive tool according to claim 1,
wherein the abrasive article comprises thermochromic colorant for determining an external surface temperature of an abrasive layer of the abrasive article.

21. An abrasive tool comprising:
an abrasive cap having a surface being circumferentially closed about the longitudinal axis and defining a cavity therein which extends along the longitudinal axis;
an abrasive carrier including a core provided at least partially in the cavity of the abrasive cap and a shaft extending from the core for connecting the abrasive carrier to a driving device for rotatably driving the abrasive carrier about the longitudinal axis,
wherein the core includes a material mixture comprising a plastic with a heat-conductive filler, wherein the plastic is foamed, and wherein the filler has a thermal conductivity greater than 35 watts per meter and per Kelvin.

* * * * *